United States Patent [19]

Vasas

[11] 3,930,280

[45] Jan. 6, 1976

[54] BOTTLE INSERT FOR PRODUCT CONTAINER

[75] Inventor: Martin M. Vasas, Fairfield, Conn.

[73] Assignee: The Bridgeport Metal Goods Manufacturing Company, Bridgeport, Conn.

[22] Filed: June 27, 1974

[21] Appl. No.: 483,694

[52] U.S. Cl. ..... 15/257.05; 401/122; 132/85

[51] Int. Cl.[2] ..... A47L 13/56; A45D 44/18

[58] Field of Search ..... 401/121, 122; 15/257.05; 132/85

[56] References Cited

UNITED STATES PATENTS

| | | | |
|---|---|---|---|
| 2,627,619 | 2/1953 | Gagen | 15/257.05 |
| 3,084,374 | 4/1963 | Ziegler | 401/122 |
| 3,372,424 | 3/1968 | Kellett | 15/257.05 |
| 3,763,870 | 10/1973 | Montgomery et al. | 132/85 |

*Primary Examiner*—Harry N. Haroian

*Attorney, Agent, or Firm*—Wooster, Davis & Cifelli

[57] ABSTRACT

Leaks are precluded in product containers with the bottle insert by structuring a rim thereon for establishing an inclined sealing interface. A diaphragm is structured within the bottle insert to provide either a cylindrical or a noncylindrical wipe over the particular type of applicator tip selected for use in the product container. Furthermore, provisions are incorporated within the bottle insert to block passage through the wiping diaphragm of misaligned comb type applicator tips and these provisions are made self-aligning for such tips with minor structural modification.

15 Claims, 11 Drawing Figures

BOTTLE INSERT FOR PRODUCT CONTAINER

BACKGROUND OF THE INVENTION

The present invention relates to a bottle insert for sealing between a reservoir assembly and an applicator in a product container, especially such an insert for providing a noncylindrical wiping action over a comb type applicator tip. Bottle inserts are utilized in reservoir assemblies containing products for a wide variety of purposes, such as cosmetics, paint, glue, or medicine and these products can be in many different forms, such as liquid, gel, or compressed powder. The applicator is detachably joined to the reservoir assembly with the bottle insert providing a seal to preclude leakage of the product therebetween. A tip extends from the applicator on a shaft to contact the product within the reservoir assembly. As the applicator is withdrawn from the reservoir assembly to dispense the product, the bottle insert provides a wiping action thereover in most product containers.

Many bottle inserts having compressible sealing rims are known in the prior art. However, such rims can be squeezed from the sealing interface within the product container when the reservoir assembly and applicator thereof are joined with excessive pressure. Because leaks are likely to develop at each void where the rim is squeezed from the sealing interface, problems have been encountered with product containers utilizing such inserts.

The wiping action of the bottle insert removes excess product from the applicator and controls the amount of product that is dispensed on the tip thereof. Many different types of applicator tips are known and although most of these types require a cylindrical wiping action, some require a noncylindrical wiping action. Applicator tips which require a cylindrical wipe include those having bristles arranged either radially or longitudinally from the applicator shaft, those having only grooves in the shaft, those utilizing either felt or cellular materials and those having a combination of such bristles, grooves and felt or cellular materials. The most commonly used applicator tip which requires a noncylindrical wipe is the type having a number of rigid combs disposed along the applicator shaft with teeth extending radially therefrom on each comb. Because the product is only dispensed from between the teeth on each comb of this tip, it is necessary to wipe across each comb and between all adjacent combs.

A cylindrical wipe is generally applied by a wiping diaphragm which has a centrally located aperture and which flexes to expand the aperture in exerting radial forces of equal magnitude around the applicator tip. The noncylindrical wipe over the comb type tip is generally applied by a wiping diaphragm which has slits extending therethrough in a radial direction from a centrally located aperture therein and on which separate portions flex between adjacent combs when the combs are passed through the slits. Because the structural and functional characteristics of these wiping diaphragms are very different, no bottle insert has yet been devised for adapting to provide either the cylindrical or noncylindrical wipe corresponding with the type of applicator tip that is selected for use in the product container. Furthermore, many difficulties are encountered with the bottle inserts known in prior art for providing the noncylindrical wipe over comb type tips. These difficulties arise mainly because the desired wiping action is only attained when the combs have been aligned to pass through the slits of the wiping diaphragm. Since the slits are visually inaccessible on the wiping diaphragm in the direction of applicator withdrawal from the product container, such alignment is accomplished only by turning the applicator while applying a force thereto in the direction of withdraw. If too much force is applied, the combs do not pass through the slits and a poor wiping action results. Damage also occurs to the wiping diaphragm from repeatedly passing the applicator therethrough with the combs misaligned from the slits.

SUMMARY OF THE INVENTION

It is, therefore, a general object of the present invention to provide a seal and/or a wiping action for product containers with a bottle insert which minimizes and obviates the disadvantages of the prior art.

It is a specific object of the present invention to provide a seal for product containers with a bottle insert which includes a rim structured to establish an inclined sealing interface.

It is a more specific object of the present invention to provide a wiping action in product containers with a bottle insert which adapts to either a cylindrically wiped applicator tip or a noncylindrically wiped comb type applicator tip.

It is another object of the present invention to provide a noncylindrical wiping action over a comb type applicator tip in product containers with a bottle insert which blocks passage of the applicator tip when the combs thereof are misaligned.

It is still another object of the present invention to provide a noncylindrical wiping action over comb type applicator tips in product containers with a bottle insert which corrects alignment of the combs on the applicator tip.

These objects are accomplished with the bottle insert of this invention by structuring thereon a sealing rim which has a thickness of varying magnitude along the insert's longitudinal axis and of increasing magnitude in a radial direction from that axis. Indentations are disposed radially from the aperture on the wiping diaphragm of the bottle insert and they concentrate the flexure stresses in the diaphragm to precisely locate fracture paths thereon when a comb type tip is passed therethrough. Buttresses are arranged within the bottle insert to block passage of the comb type tip through the diaphragm when the individual combs thereof are misaligned in the insert. A central ridge with tapered surfaces to each side thereof is disposed on each buttress to aligningly direct the combs into the diaphragm.

BRIEF DESCRIPTION OF THE DRAWINGS

The manner in which these and other objects of the invention are achieved will be best understood by reference to the following description, the appended claims and the Figures of the attached drawings wherein:

DESCRIPTION OF THE PREFERRED EMBODIMENT

Figure 1:
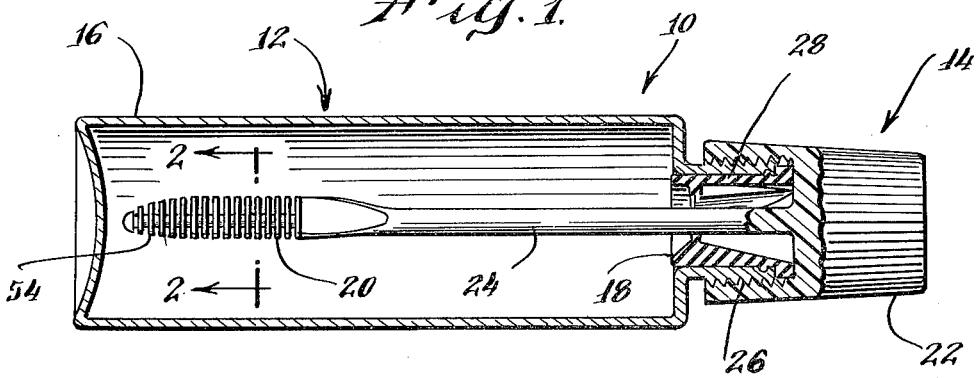
FIG. 1 is an elevational view of a product container with portions thereof cutaway to disclose the internal components including the bottle insert of this invention.

Turning now to the drawings and more particularly to FIG. 1, there is illustrated a product container 10 in which a reservoir assembly 12 and an applicator 14 are detachably joined. Generally, the reservoir assembly 12 includes a reservoir bottle 16 through which a bottle insert 18 is disposed, while the applicator 14 includes a tip 20 which is interconnected to a cap 22 by a shaft 24. Product is dispensed from the reservoir assembly 12 with the applicator 14 by withdrawing the tip 20 through the insert 18. The product container 10 is sealed against leakage by the insert 18 which also provides a wiping action over the applicator 14 and it is primarily to the insert 18 that this invention relates.

Any suitable elastic material may be utilized to fabricate the insert 18, such as an elastomeric and any suitable process may be utilized for its fabrication, such as molding. The reservoir bottle 16 is sized in accordance with the amount of product to be stored and it includes a bottleneck 26 within which the insert 18 is retained. Within the concept of this invention the insert 18 could have numerous embodiments, however, only the preferred embodiment thereof is illustrated in FIGS. 3 – 9. The insert 18 is structured in the form of a tubular frame 28 on which an annular locking lip 30 is externally disposed between a sealing rim 32 at one longitudinal end and a tapered lead 34 at the other longitudinal end. Although the inside diameter of the bottleneck 26 and the outside diameter of the tubular frame 28 must correspond generally in size, an interference fit can exist therebetween. An annular groove 36 is disposed around the inside of the bottleneck 26 and the annular locking lip 30 engagingly cooperates therewith to establish an interlock between the insert 18 and the reservoir bottle 16. However, any suitable means could be utilized for retaining the insert 18 within the bottleneck 26. The insert 18 is merely pushed into the bottleneck 26 and the tapered lead 34 serves to facilitate this assembly operation after which the sealing rim 32 is peripherally disposed around the end of the bottleneck 26. When the applicator 14 is joined to the reservoir assembly 12, the sealing rim 32 becomes interfacingly compressed between the reservoir bottle 16 and the cap 22 to seal the product container 10. Any suitable means for joining the applicator 14 to the reservoir assembly 12 can be utilized, such as male threads 38 on the bottleneck 26 which mate with female threads 40 in the cap 22.

Of course, the sealing rim 32 distorts when it is compressed to develop the desired seal. Because such distortion generally occurs in directions perpendicular to the compressive forces applied, much of the sealing rim 32 would be forced down inside the bottleneck 26 if the sealing interface were merely flat across the product container 10. Furthermore, the sealing rim 32 could then be squeezed from within the sealing interface by compressive forces of excessive magnitudes to cause voids at which leaks would develop in the product container 10. This difficulty is overcome by structuring the sealing rim 32 to create an outwardly inclined sealing interface in the product container 10. To accomplish this the thickness of the sealing rim 32 is varied along the longitudinal axis of the tubular frame 28 by increasing the magnitude thereof in a radial direction away from that axis. A tapered side 42 extending from the tubular frame 28 is disposed on the sealing rim 32 to achieve this varying thickness. However, either and/or both sides of the sealing rim 32 could be tapered or could be otherwise contoured within the scope of this invention. To magnify the outward incline of the sealing interface, the end of the bottleneck 26 is tapered in a direction corresponding to that of the tapered side 42 but this corresponding taper is not absolutely necessary to this invention. Within the product container 10, the outwardly inclined sealing interface causes distortion of the sealing rim 32 to flow radially away from the longitudinal axis of the tubular frame 28. Therefore, the sealing rim 32 will not be squeezed from within the sealing interface when compressive forces of excessive magnitudes are imposed thereon.

Interiorly within the insert 18, a wiping diaphragm 44 and at least one alignment buttress 46 are disposed on the tubular frame 28. The diaphragm 44 is arranged across the tubular frame 28 between the longitudinal ends thereof. An aperture 48 passes through the diaphragm 44 and is concentrically located about the longitudinal axis of the tubular frame 28. A single buttress 46 can be disposed to either side of the diaphragm 44 within the scope of this invention, however, a plurality of buttresses 46 are equiangularly distributed around the tubular frame 28 on both sides of the diaphragm 44 with a portion 50 of the diaphragm 44 separating between angularly adjacent buttresses 46 in the preferred embodiment illustrated by FIGS. 3 –9. Furthermore, on the surface of the diaphragm 44 facing in the direction of the sealing rim 32, each separating portion 50 includes an indentation 52 extending radially from the longitudinal axis of the tubular frame 28. Regardless of the particular embodiment, each buttress 46 is disposed to one side of the diaphragm 44 and extends from one longitudinal end of the tubular frame 28 with an increasing incline in the direction of the diaphragm 44. Of course, the separating portions 50 are nonexistent for embodiments which have only a single buttress 46, however, the indentations 52 may be disposed on the diaphragm 44 in such embodiments with the single buttress 46 disposed between adjacent indentations 52.

Figure 3:
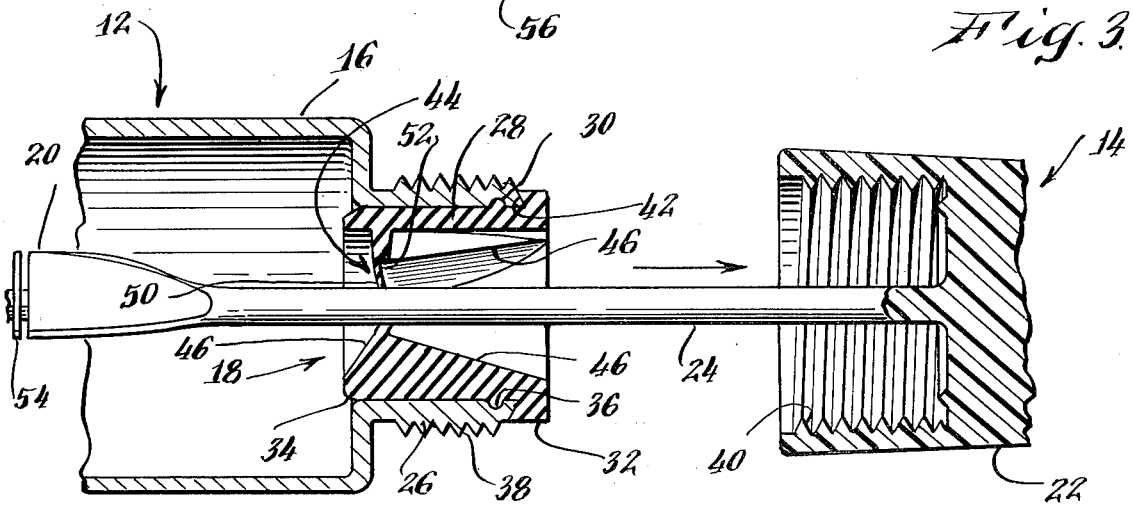
FIG. 3 is an enlarged partial elevational view of the product container with portions thereof cutaway to illustrate the wiping action that is achieved against the applicator shaft by the diaphragm of the bottle insert when the applicator is withdrawn from the reservoir assembly.
Figure 4:
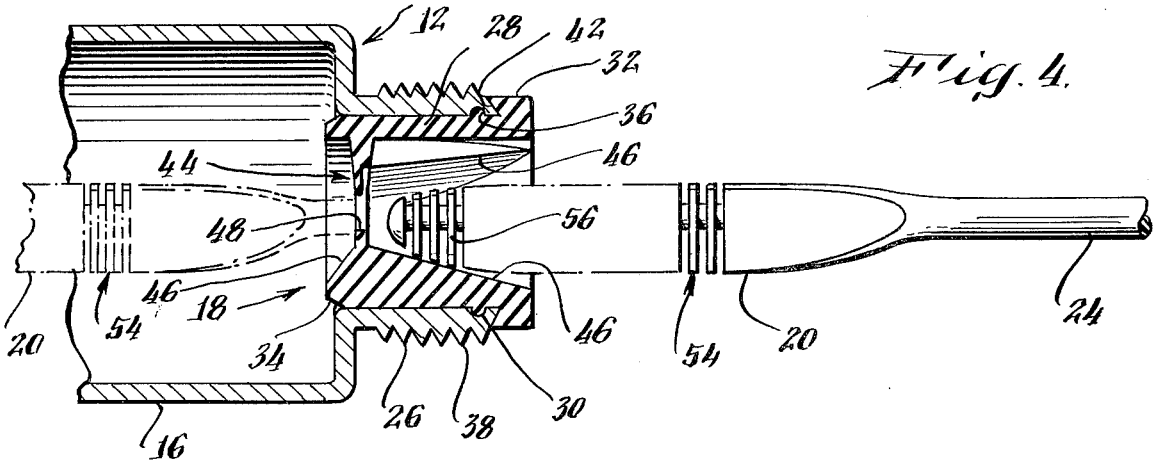
FIG. 4 is an enlarged partial elevational view of the product container with portions thereof cutaway to illustrate the interference caused between the combs and the buttresses when the applicator tip is misaligned on either insertion or withdrawal, the latter being shown in phantom.

As illustrated in FIG. 3, when the shaft 24 is of greater diameter than the aperture 48, a cylindrical wipe is applied thereto by the diaphragm 44. This is so because wiping forces of equal magnitude are developed around the shaft 24 by the diaphragm 44 which flexes to radially enlarge the aperture 48. As will be explained later in this description, a noncylindrical wipe must be applied over the comb type tip 20, however, it should be realized without further discussion that a cylindrical wipe would also be applied by the diaphragm 44 to other known types of applicator tips. As was previously discussed, such applicator tips would include those with either radially or longitudinally aligned bristles, those with only grooves in the shaft, those of either felt or cellular materials, and those which combine such bristles, grooves and felt or cellular materials.

Figure 2:
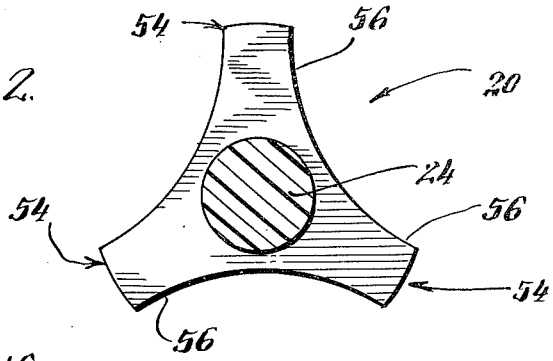
FIG. 2 is an enlarged sectional view taken substantially along line 2—2 of FIG. 1 to illustrate the equiangular distribution of the combs on the applicator tip.

The tip 20 is of the comb type and therefore, includes rigid combs 54 which are disposed along the shaft 24, as illustrated in FIG. 2. Each comb 54 has several teeth 56 which extend radially from the shaft 24 and although the tip 20 has only three combs 54, the number of combs utilized thereon will depend upon the product application. Because a comb type tip only dispenses product from between the teeth of the combs, it is necessary to wipe the tip 20 across each comb 54 and between adjacent combs 54 when the applicator 14 is withdrawn from the reservoir assembly 12. Such a noncylindrical wipe is applied by the insert 18 after the diaphragm 44 has been flexed to fracture slits therethrough radially along the indentations 52. Of course, the diaphragm 44 is much thinner at the indentations 52 and therefore, any flexure stresses therein will be concentrated along the indentations 52. Also, the flexure stresses can be further concentrated within the diaphragm 44 by passing the tip 20 therethrough with the combs 54 and indentations 52 aligned.

Figure 5:
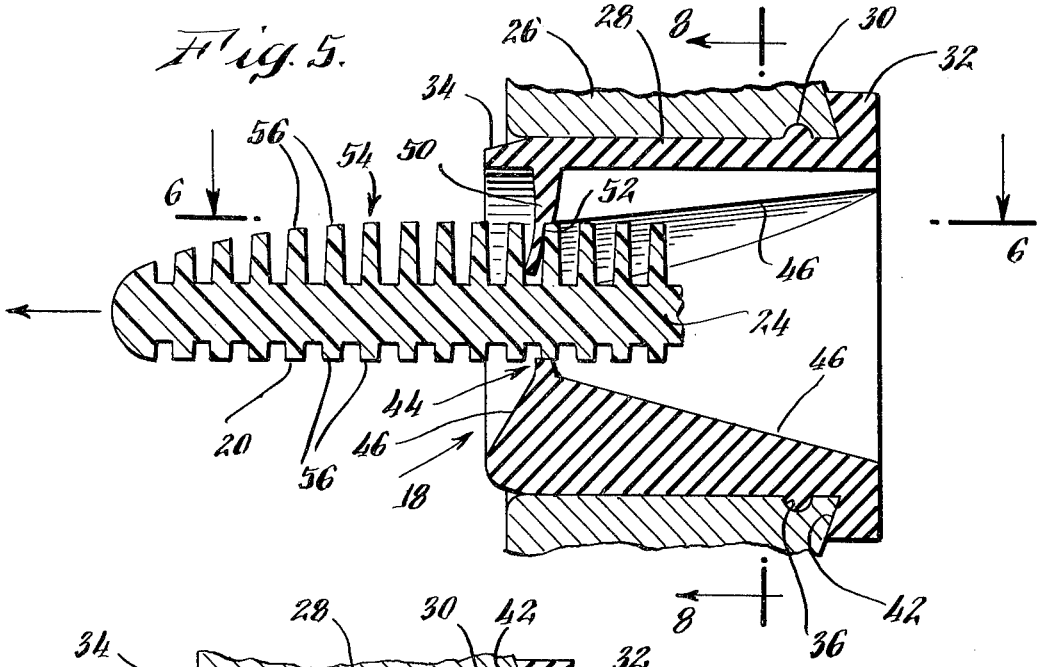
FIG. 5 is an enlarged sectional view through the bottle insert portion of the product container and generally illustrates the noncylindrical wiping action of the diaphragm over the comb type tip.
Figure 6:
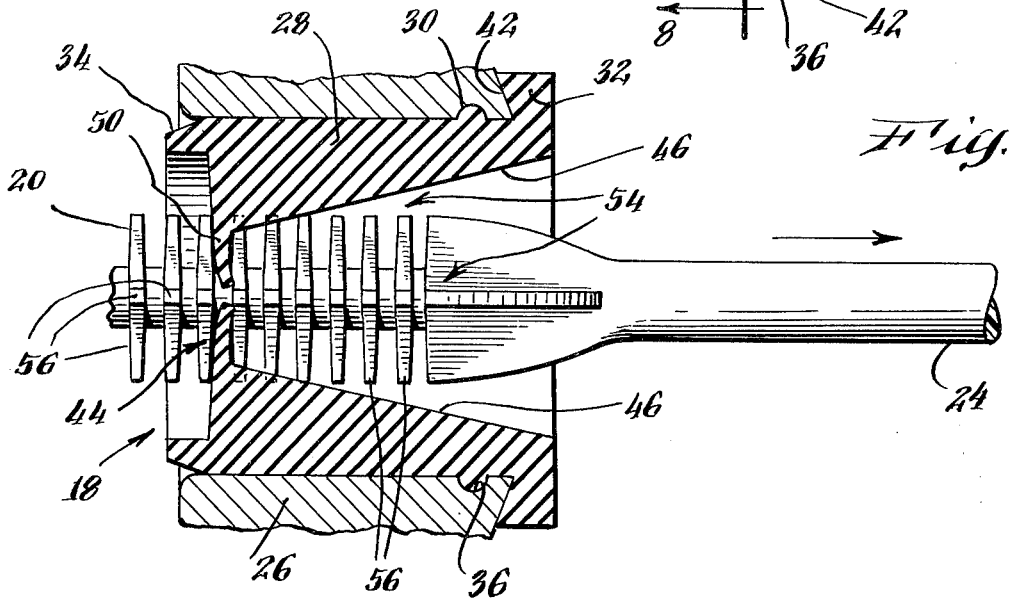
FIG. 6 is a sectional view taken substantially along line 6—6 of FIG. 5 to illustrate the wipe attained across each comb by the noncylindrical wiping action.

The diaphragm 44 then provides the desired wipe over the tip 20 with the slits wiping across the combs 54, as illustrated in FIG. 6 and the separate portions existing on the diaphragm 44 between adjacent slits wiping between adjacent combs 54, as is illustrated in FIG. 5. Of course, the number of indentations 52 on the diaphragm 44 or the number of slits therethrough must at least be equal to the number of combs 54 on the tip 20 but could be equal to the number of combs 54 multiplied by any integer greater than zero, as will be explained below. It should be realized without further discussion that until the indentations 52 are fractured, the diaphragm 44 will continue to apply a cylindrical wipe over a shaft or applicator tip passing therethrough. Furthermore, the noncylindrical wiping action is only applied over the tip 20 when the combs 54 are passed through the slits and the diaphragm 44 can be damaged by repeatedly passing the tip 20 therethrough without proper alignment existing therebetween.

Although the indentations 52 could have many different configurations, the triangular configuration illustrated is preferable for many comb type applicators. Each triangular indentation is disposed on the diaphragm 44 with its apex on the periphery of the aperture 48 and one side perpendicularly across a radial line passing through the apex from the longitudinal axis of the tubular frame 28 and at a distance therealong equal to at least the maximum height of the combs 54 on the applicator 14. Due to this triangular shape, the slits occur through a very thin web on the diaphragm 44 and therefore, very flexible portions are available on each side of the slits for wiping across the combs 54.

The inclined surface presented by only one of the buttresses 46 on either side of the diaphragm 44 is sufficient to block passage of the tip 20 through the insert 18 when the combs 54 are misaligned with the slits in the diaphragm 44 and/or the indentations 52 thereon. This is best understood from FIG. 4 where the tip 20 is shown to be misaligned at both sides of the diaphragm 44 and where an abutting interface is shown between one comb 54 and one buttress 46. The tip 20 is precluded from passing through the insert 18 in one direction by the abutting interface and when only a single buttress 46 is utilized, the diaphragm 44 is rigidified thereby to also preclude passage of the tip 20 in the other direction. No reasonable force can be applied on the applicator 14 to pass the tip 20 through the insert 18 when a misaligned condition exists and when such a condition is realized by the operator, the aligned position is found by slowly turning the tip 20 within the insert 18, while applying a reasonable force thereto in the direction of the diaphragm 44. As was discussed previously, a plurality of buttresses 46 would be disposed on both sides of the diaphragm 44 in the preferred embodiment of the insert 18. Furthermore, it should be understood without further discussion that the buttresses 46 can be utilized in the insert 18 whether the diaphragm 44 thereof includes slits therethrough or indentations 52 thereon.

Figure 7:
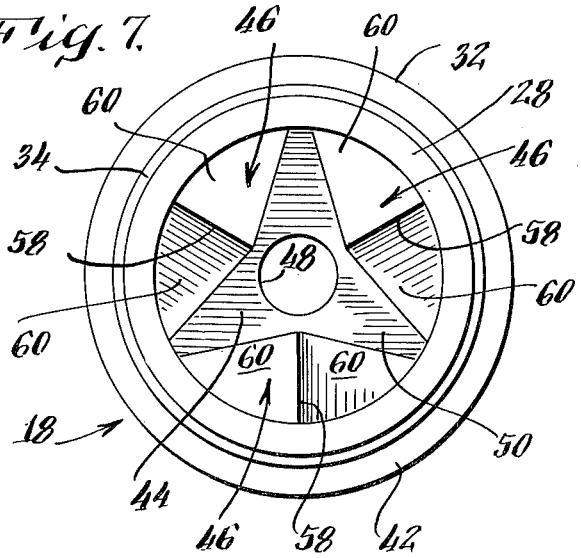
FIG. 7 is an enlarged elevational end view of the bottle insert in the direction of applicator withdrawal from the reservoir assembly.
Figure 8:
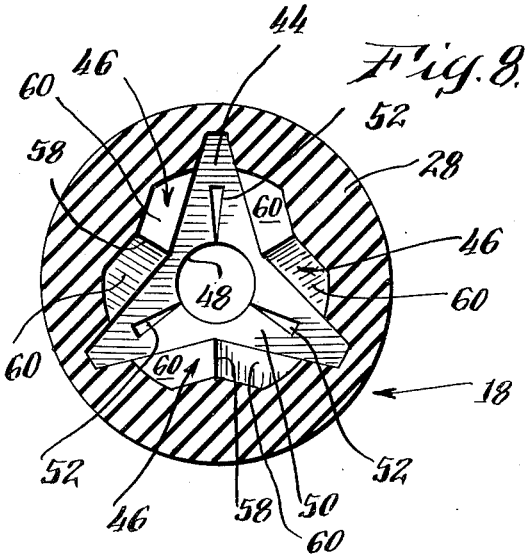
FIG. 8 is a sectional view of the bottle insert taken substantially along line 8—8 of FIG. 5 to illustrate the internal structure thereof, particularly the wiping diaphragm and buttresses.
Figure 9:
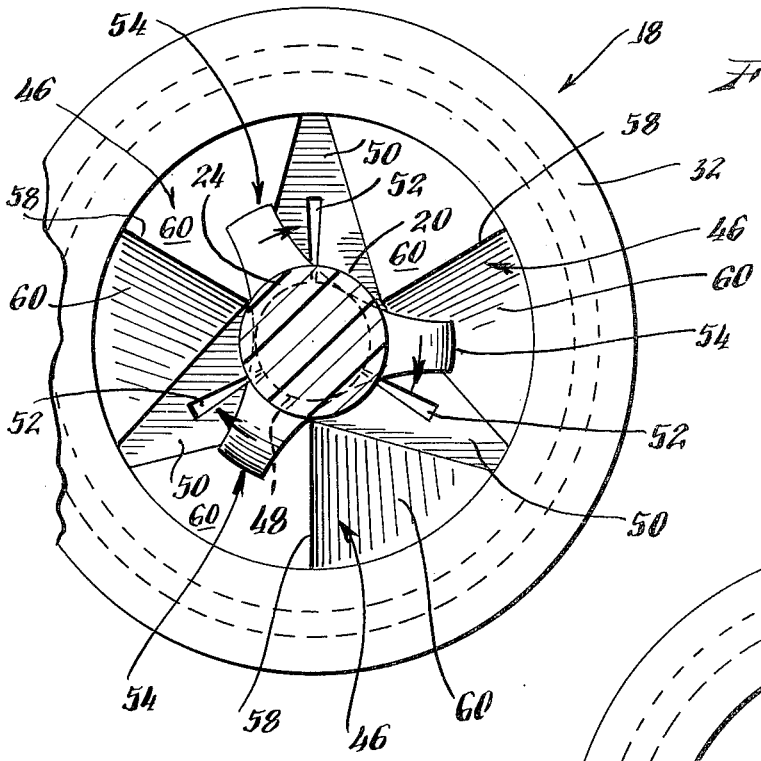
FIG. 9 is an enlarged end view of the bottle insert in the direction of applicator insertion with a comb type tip misaligned therein to illustrate the alignment correction that results therebetween due to the buttresses.

When a tip aligning action is desired within the insert 18, a central ridge 58 is disposed along the incline of each buttress 46 and tapered surfaces 60 are extended on each side thereof from the central ridge 58 to the tubular frame 28. This configuration is best illustrated in FIG. 7 for the buttresses 46 on the side of the diaphragm 44 facing the tapered lead 34 and in FIG. 8 for the buttresses 46 on the side of the diaphragm 44 facing the sealing rim 32. The aligning action is best understood from FIG. 9 where the tip 20 is shown misaligned within the insert 18. Of course, the central ridge 58 presents only an edge along the incline and on the ends of the teeth 56, the combs 54 present very little surface area. Therefore, the combs 54 will always be diverted on abutment with the central ridge 58 to one of the tapered surfaces 60 on either side thereof. Relative to the ends of the teeth 56, each tapered surface 60 is of increasing taper in the direction of the diaphragm 44 and of decreasing taper in the direction of the tubular frame. Consequently, any force applied thereagainst in the direction of the diaphragm 44 by the tip 20 is translated into a torsional force on the comb 54 in the direction of the nearest slit or indentation 52, as illustrated by the arrows in FIG. 9. Therefore, regardless of the initial orientation of the tip 20 within the insert 18, an aligning action is always provided by the buttresses 46 to direct the combs 54 into the slits or indentations 52.

Figure 10:
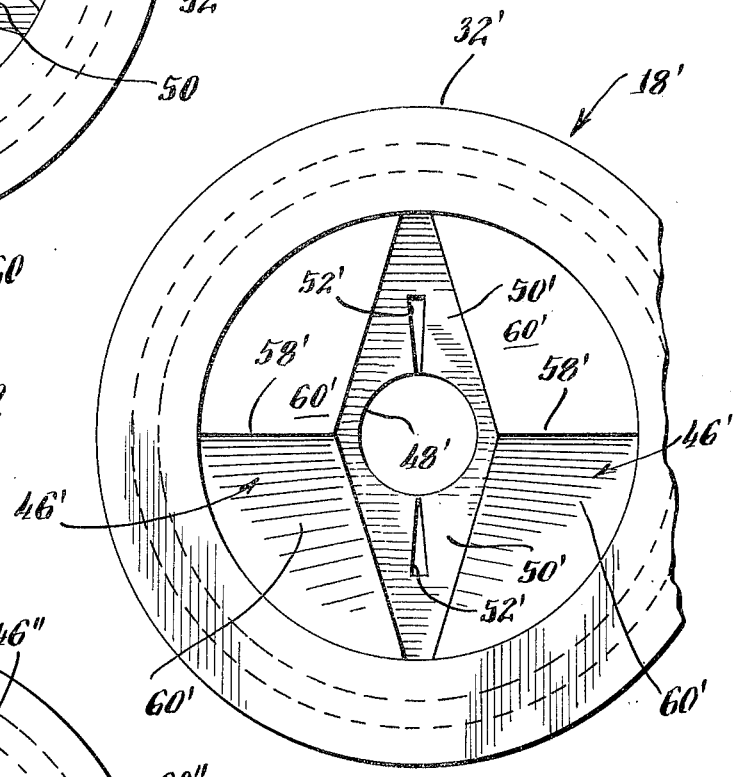
FIG. 10 is a view similar to FIG. 9 of a bottle insert having two buttresses and a wiping diaphragm with two indentations.
Figure 11:
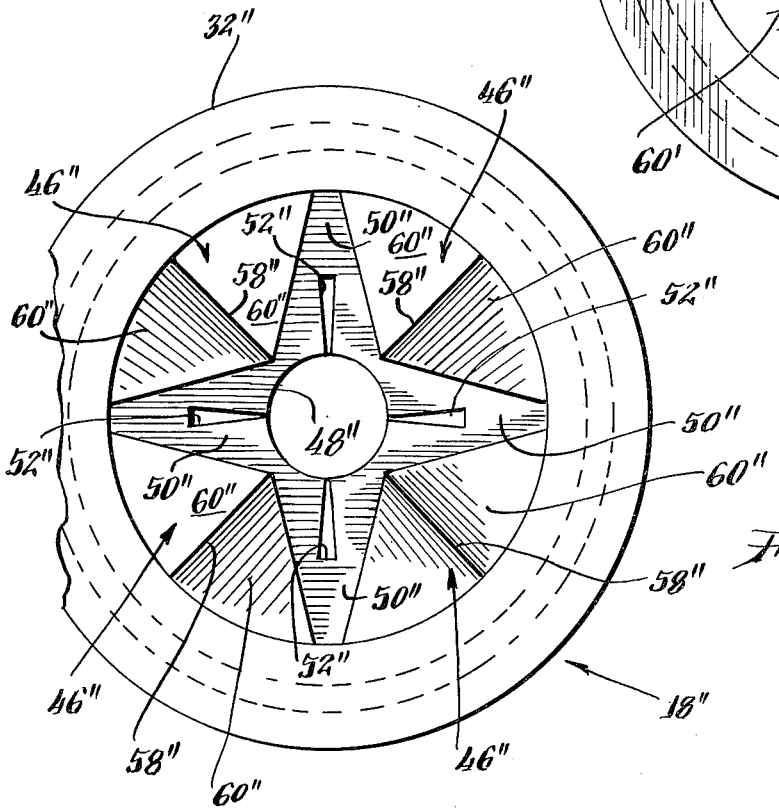
FIG. 11 is a view similar to FIG. 9 of a bottle insert having four buttresses and a wiping diaphragm with four indentations.

An insert embodying the concept of this invention is possible for a comb type tip having any number of combs. Although a single buttress could be utilized in such inserts, only the preferred embodiments thereof with a plurality of buttresses will be discussed. One such insert 18' is illustrated in FIG. 10, where because of the similarities which exist with the insert 18 of FIGS. 1 and 3 – 9, similar parts are identified by the same reference numerals as used in FIGS. 1 and 3 – 9, but with a prime (′) added. Two slits or indentations 52′ are disposed through the diaphragm 44′, each of which separates between adjacent buttresses 46′ on each side of the diaphragm 44′. Because there are two slits or indentations 52′, insert 18′ can be utilized to align and wipe comb type tips with either one or two combs. Another such insert 18″ is illustrated in FIG. 11 where, because of the similarities which exist with the insert 18 of FIGS. 1 and 3 – 9, similar parts are identified by the same reference numerals as used in FIGS. 1 and 3 –9, but with a double prime (″) added. Four slits or indentations 52″ are disposed through the diaphragm 44″, each of which separates between adjacent buttresses 46″ on each side of the diaphragm 44″. Because there are four slits or indentations 52″, insert 18″ can be utilized to align and wipe comb type tips with one, two or four equiangularly disposed combs. From the inserts 18′ and 18″ of FIGS. 10 and 11 respectively, it should be realized without further discussion that an applicator having a tip with two combs could be utilized with either of these inserts. Furthermore, it should be realized from these inserts that the number of slits disposed through the diaphragm or the number of indentations disposed thereon must be equal to the number of combs on the tip but could be equal to the number of combs on the tip multiplied by any integer greater than zero.

Those skilled in the art should appreciate that the bottle insert of this invention may include a sealing rim of varying thickness to establish an outwardly inclined sealing interface within a product container. Also, indentations may be disposed on a diaphragm within the bottle insert for adapting it to either cylindrically wiped applicator tips or non-cylindrically wiped comb type applicator tips. Furthermore, buttresses may be included within the bottle insert to either block passage of misaligned comb type applicator tips therethrough or apply an aligning action to such applicator tips.

It should be understood that the present disclosure has been made by way of example and the numerous changes in the details of construction and the combination or arrangement of parts may be resorted to without departing from the true spirit and the scope of this invention. Therefore, the present disclosure should be construed as illustrative rather than limiting.

What I claim is:

1. An insert for sealing between a reservoir assembly and an applicator of a product container and for wiping over the applicator therein, said insert being fabricated of elastic material and comprising:

a tubular having a longitudinal axis;

a wiping diaphragm disposed across said tubular frame between the longitudinal ends thereof, said diaphragm having an aperture disposed therethrough concentrically about said longitudinal axis; and a sealing rim disposed on the external periphery of said tubular frame and at one longitudinal end thereof, said sealing rim having a flat end wall disposed in a radial plane and facing away from said insert and a tapered inner wall disposed longitudinally inwardly of said end wall, whereby said rim is of varying thickness along said longitudinal axis, said varying thickness being of increasing magnitude in a radial direction away from said longitudinal axis, said sealing rim being compressible across said varying thickness within the product container and being distorted therein radially away from said longitudinal axis.

2. An insert for use within a product container to wipe comb type applicators and to assure proper alignment therein of such applicators, said insert being fabricated of elastic material and comprising:

a tubular frame having a longitudinal axis;

a wiping diaphragm disposed across said tubular frame between the longitudinal ends thereof, said diaphragm having an aperture and radial slits disposed therethrough, said aperture being concentric about said longitudinal axis with said radial slits extending from the periphery of said aperture; and at least one buttress disposed within said tubular frame to one side of said diaphragm, each said buttress extending from one end of said tubular frame to said diaphragm and having an increasing incline in the direction of said diaphragm, each said buttress being disposed between adjacent radial slits on said diaphragm and precluding passage of the applicator through said insert when the combs thereon are misaligned with said radial slits.

3. The insert of claim 2 wherein each said buttress includes a central ridge along said incline with tapered surfaces extending on each side of said central ridge to said tubular frame, said central ridge and said tapered surfaces cooperating to align the combs of the applicator with said radial slits.

4. The insert of claim 2 wherein buttresses are disposed on both sides of said diaphragm.

5. The insert of claim 4 wherein each said buttress includes a central ridge along said incline with tapered surfaces extending on each side of said central ridge to said tubular frame, said central ridges and said tapered surfaces cooperating to align the combs of the applicator with said radial slits.

6. An insert for use within a product container to provide a wiping action over cylindrically wiped applicators and noncylindrically wiped comb type applicators, said insert being fabricated of elastic material and comprising:

a tubular frame having a longitudinal axis;

a wiping diaphragm disposed across said tubular frame between the longitudinal ends thereof, said diaphragm having an aperture disposed therethrough and indentations disposed therein, said aperture being concentric about said longitudinal axis with said indentations extending radially from the periphery of said aperture, said diaphragm being flexible to expand said aperture in exerting radial forces of equal magnitude concentrically about said longitudinal axis with said indentations concentrating the flexure stresses therein to the point of fracture at which slits develop through said diaphragm along said indentations.

7. The insert of claim 6 wherein said indentations are triangularly shaped, each said indentation having an apex disposed on the periphery of said aperture and one side disposed perpendicularly across a radial line passing through said apex from said longitudinal axis at a distance therefrom equal to at least the maximum comb height of the comb type applicators.

8. The insert of claim 6 wherein at least one buttress is disposed within the said tubular frame to one side of said diaphragm, each said buttress extending from one end of said tubular frame to said diaphragm and having an increasing incline in the direction of said diaphragm, each said buttress being disposed between adjacent indentations on said diaphragm and precluding passage of comb type applicators through said insert when the combs thereon are misaligned with said indentations.

9. The insert of claim 8 wherein each said buttress includes a central ridge along said incline with tapered surfaces extending on each side of said central ridge to said tubular frame, said central ridge and said tapered surfaces cooperating to align combs on comb type applicators with said indentations.

10. The insert of claim 8 wherein buttresses are disposed on both sides of said diaphragm.

11. The insert of claim 10 wherein each said buttress includes a central ridge along said incline with tapered surfaces extending on each side of said central ridge to said tubular frame, said central ridges and said tapered surfaces cooperating to align combs on comb type applicators with said indentations.

12. The insert of claim 8 wherein a sealing rim is disposed on the external periphery of said tubular frame and at one longitudinal end thereof, said sealing rim being of varying thickness along said longitudinal axis, said varying thickness being of increasing magnitude in a radial direction away from said longitudinal axis, said sealing rim being compressible across said varying thickness within the product container and being distorted therein radially away from said longitudinal axis.

13. The insert of claim 12 wherein said sealing rim includes a tapered side extending from said tubular frame.

14. The insert of claim 12 wherein each said buttress includes a central ridge along said incline with tapered surfaces extending on each side of said central ridge to said tubular frame, said central ridge and said tapered surfaces cooperating to align combs on comb type applicators with said indentations.

15. An insert for sealing between a reservoir assembly and an applicator of a product container and for providing a wiping action over cylindrically wiped applicators and noncylindrically wiped comb type applicators, said insert being fabricated of elastic material and comprising:

a tubular frame having a longitudinal axis;

a wiping diaphragm disposed across said tubular frame between the longitudinal ends thereof, said diaphragm having an aperture disposed therethrough and indentations disposed therein, said aperture being concentric about said longitudinal axis with said indentations extending radially from the periphery of said aperture, said diaphragm being flexible to expand said aperture in exerting radial forces of equal magnitude concentrically about said longitudinal axis with said indentations concentrating the flexure stresses therein to the point of fracture at which slits develop through said diaphragm along said indentations;

buttresses disposed within said tubular frame on both sides of said diaphragm, each said buttress extending from one end of said tubular frame to said diaphragm and having an increasing incline in the direction of said diaphragm, each said indentation being disposed between adjacent buttresses on said diaphragm, each said buttress including a central ridge along said incline with tapered surfaces extending on each side of said central ridge to said tubular frame, said central ridges and said tapered surfaces cooperating to align combs on comb type applicators with said indentations.

* * * * *